US010684068B1

(12) United States Patent
Shi et al.

(10) Patent No.: US 10,684,068 B1
(45) Date of Patent: Jun. 16, 2020

(54) LIGHTED WATER DISPENSING

(71) Applicant: Electrolux Home Products, Inc., Charlotte, NC (US)

(72) Inventors: Zhuochen Shi, Clemson, SC (US); Thomas McCollough, Piedmont, SC (US); Marcelo Candeo, Anderson, SC (US); Cornel Comsa, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 16/357,616

(22) Filed: Mar. 19, 2019

(51) Int. Cl.
*F25D 27/00* (2006.01)
*F25D 23/12* (2006.01)

(52) U.S. Cl.
CPC ..... *F25D 27/005* (2013.01); *F25D 23/126* (2013.01); *F25D 2327/001* (2013.01)

(58) Field of Classification Search
CPC . F25D 2327/001; F25D 27/005; F25D 23/126
USPC ..... 222/113
See application file for complete search history.

(56) References Cited

U.S. PATENT DOCUMENTS 8,109,301 B1 * 2/2012 Denise ..... F25D 23/126 141/360
8,109,411 B2 * 2/2012 Yang ..... G01F 13/006 222/113
9,073,743 B2 7/2015 Sanchez et al.
9,920,604 B2 3/2018 Jamison et al.
2006/0144075 A1 * 7/2006 Bowen ..... F25D 23/126 62/344
2007/0044497 A1 * 3/2007 Roo ..... F25D 27/005 62/264
2008/0163641 A1 * 7/2008 Mitchell ..... B67D 1/0875 62/389
2011/0174008 A1 * 7/2011 Kim ..... F25D 23/126 62/264
2012/0103001 A1 * 5/2012 Krause ..... G02B 6/0008 62/389
2012/0180517 A1 * 7/2012 Filho ..... B67D 1/0003 62/389
2013/0146612 A1 * 6/2013 Sanchez ..... B67D 1/0889 222/28
2014/0111118 A1 * 4/2014 Kendall ..... H05B 37/0218 315/362
2014/0299628 A1 * 10/2014 Gormley ..... B67D 1/0872 222/113
2017/0248363 A1 * 8/2017 Eicher ..... F21V 23/0471
2019/0023551 A1 1/2019 Sanchez et al.

* cited by examiner

*Primary Examiner* — Donnell A Long
(74) *Attorney, Agent, or Firm* — Pearne & Gordon LLP

(57) ABSTRACT

A refrigeration appliance that includes a cabinet defining a storage compartment. A door is pivotably coupled to the cabinet and movable between a closed position for closing the storage compartment and an open position for allowing access to the storage compartment. A dispensing assembly is disposed on at least one of the cabinet and the door for supplying water and/or ice. The dispensing assembly includes a dispensing tube fluidly connected to a source of water and having an outlet opening for allowing a stream of water to exit the dispensing tube upon command and an illumination system for illuminating a predetermined target location that corresponds to a position of a terminal end of the stream of water exiting from the dispensing tube.

6 Claims, 11 Drawing Sheets

LIGHTED WATER DISPENSING

FIELD OF THE INVENTION

This application relates generally to a refrigeration appliance, and more particularly, to a refrigeration appliance that includes a dispenser in a door of the refrigeration appliance for delivering water and/or ice to a user.

BACKGROUND OF THE INVENTION

Refrigeration appliances, such as household refrigerators for example, often are provided with ice and water dispensing systems and units that include dispensing stations at which ice and water can be accessed by users. The dispensing stations can be located at the exteriors of doors that serve to close off the interiors of the refrigeration appliance compartments. In the case of a side-by-side household refrigerator for example, the ice and water dispensing station typically is located at the exterior of the freezer compartment door. On the other hand, in the case of a bottom-mount household refrigerator, that is, a refrigerator in which the freezer compartment is located beneath the fresh food compartment, the ice and water dispensing station typically is located at the exterior of a single door at the fresh food compartment or one of the doors a French-style door arrangement.

A variety of mechanisms and arrangements are known for initiating and executing the dispensing of the ice and water from ice-making and ice-storage systems and water sources, respectively, at the dispensing stations of refrigeration appliances. For example, some ice and water dispensing stations include a cavity in the door of the refrigeration appliance and one or two actuators are mounted in the cavity. One of the actuators causes ice to be dispensed into a receptacle when the receptacle is pressed against the one actuator and the other of the actuators causes water to be dispensed into the receptacle when the receptacle is pressed against the other actuator. In another example, ice and water selection devices such as electrical push buttons or touch screens, for example, are provided at the dispensing station. The ice selection device can be engaged by a user to initiate the delivery of ice to the dispensing station at which the ice can be dispensed into a receptacle that is placed there; and the water selection device can be engaged by a user to initiate the delivery of water to the dispensing station at which the water can be dispensed into a receptacle that is placed there for that purpose. In even other instances, combinations of actuators and selection devices are employed to cause the dispensing of ice and water at the dispensing station.

The present invention provides a system for illuminating a target location where water will be dispensed from the dispensing station.

BRIEF SUMMARY OF THE INVENTION

There is provided a refrigeration appliance that includes a cabinet defining a storage compartment. A door is pivotably coupled to the cabinet and movable between a closed position for closing the storage compartment and an open position for allowing access to the storage compartment. A dispensing assembly is disposed on at least one of the cabinet and the door for supplying water and/or ice. The dispensing assembly includes a dispensing tube fluidly connected to a source of water and having an outlet opening for allowing a stream of water to exit the dispensing tube upon command and an illumination system for illuminating a predetermined target location that corresponds to a position of a terminal end of a stream of water exiting from the dispensing tube.

There is also provided a refrigeration appliance that includes cabinet defining a storage compartment. A door is pivotably coupled to the cabinet and movable between a closed position for closing the storage compartment and an open position for allowing access to the storage compartment. A dispensing assembly is disposed on at least one of the cabinet and the door for supplying water and/or ice. The dispensing assembly includes a dispensing tube fluidly connected to a source of water and having an outlet opening for allowing a stream of water to exit the dispensing tube upon command and an illumination device disposed proximate the dispensing tube for illuminating the stream of water exiting from the dispensing tube.

DESCRIPTION OF EXAMPLE EMBODIMENTS

Figure 1:
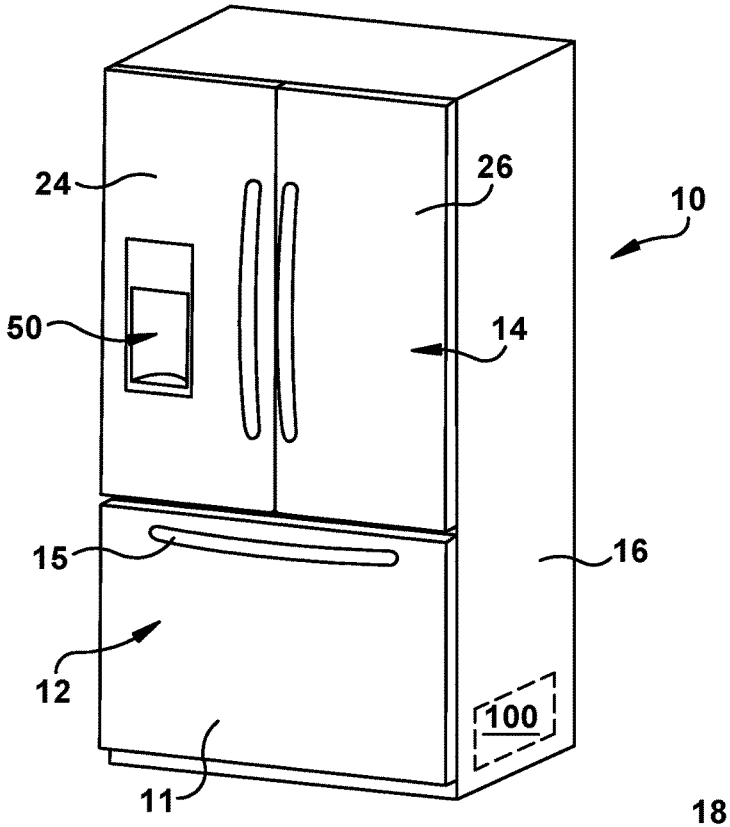
FIG. 1 is a front view of a household refrigeration appliance showing a bottom-mount freezer compartment below a fresh food compartment, wherein a dispensing station is disposed in one French-style door.

Referring now to the drawings, FIG. 1 shows a refrigeration appliance in the form of a domestic refrigerator, indicated generally at 10. Although the detailed description that follows concerns a domestic refrigerator 10, the invention can be embodied by refrigeration appliances other than with a domestic refrigerator 10. Further, an embodiment is described in detail below, and shown in the figures as a bottom-mount configuration of a refrigerator 10, including a fresh food compartment 14 disposed vertically above a freezer compartment 12. However, the refrigerator 10 can have any desired configuration including at least a fresh food compartment 14 and an ice maker 18 (FIG. 2), such as a top mount refrigerator (freezer disposed above the fresh food compartment), a side-by-side refrigerator (fresh food compartment is laterally next to the freezer compartment), a standalone refrigerator or freezer, etc.

One or more doors 24, 26 shown in FIG. 1 are pivotally coupled to a cabinet 16 of the refrigerator 10 to restrict and grant access to the fresh food compartment 14. The refrigerator 10 can include a single door that spans the entire lateral distance across the entrance to the fresh food compartment 14, or can include a pair of French-style doors 24, 26 as shown in FIG. 1 that collectively span the entire lateral distance of the entrance to the fresh food compartment 14 to enclose the fresh food compartment 14. For the latter configuration, a center flip mullion 13 (FIG. 2) is pivotally coupled to at least one of the doors 26 to establish a surface against which a seal provided to the other one of the doors 24 can seal the entrance to the fresh food compartment 14 at a location between opposing side surfaces (FIG. 2) of the doors 24, 26. The center mullion 13 can be pivotally coupled to the door 26 to pivot between a first orientation that is substantially parallel to a planar surface of the door 26 when the door 26 is closed, and a different orientation when the door 26 is opened. The externally-exposed surface of the center mullion 13 is substantially parallel to the door 26 when the center mullion 13 is in the first orientation, and forms an angle other than parallel relative to the door 26 when the center mullion 13 is in the second orientation. The seal and the externally-exposed surface of the center mullion 13 cooperate approximately midway between the lateral sides of the fresh food compartment 14.

A dispensing assembly 50 (FIG. 1) for dispensing at least ice pieces, and optionally water, can be provided on an exterior of one of the doors 24 that restricts access to the fresh food compartment 14. The dispensing assembly 50 includes at least one lever, switch, proximity sensor or other device that a user can interact with to cause frozen ice pieces to be dispensed from the ice maker 18 disposed within the fresh food compartment 14. Ice pieces from the ice maker 18 can exit the ice maker 18 through the outlet 18*a* and be delivered to the dispensing assembly 50 via an ice chute 22 (FIG. 2), which extends at least partially through the door 24 between the dispensing assembly 50 and the ice maker 18. The dispensing assembly 50 may also include at least one lever, switch, proximity sensor or other device that the user can interact with to cause water to be dispensed from source of water.

Referring to FIG. 1, the freezer compartment 12 is arranged vertically beneath the fresh food compartment 14. A drawer assembly (not shown) including one or more freezer baskets (not shown) can be withdrawn from the freezer compartment 12 to grant a user access to food items stored in the freezer compartment 12. The drawer assembly can be coupled to a freezer door 11 that includes a handle 15. When a user grasps the handle 15 and pulls the freezer door 11 open, at least one or more of the freezer baskets is caused to be at least partially withdrawn from the freezer compartment 12.

The freezer compartment 12 is used to freeze and/or maintain articles of food stored in the freezer compartment 12 in a frozen condition. For this purpose, the freezer compartment 12 is in thermal communication with a freezer evaporator (not shown) that removes thermal energy from the freezer compartment 12 to maintain the temperature therein at a temperature of 0° C. or less during operation of the refrigerator 10, preferably between 0° C. and −50° C., more preferably between 0° C. and −30° C. and even more preferably between 0° C. and −20° C.

The refrigerator 10 includes an interior liner 19 (FIG. 2) that defines the fresh food compartment 14. The fresh food compartment 14 is located in the upper portion of the refrigerator 10 in this example and serves to minimize spoiling of articles of food stored therein. The fresh food compartment 14 accomplishes this by maintaining the temperature in the fresh food compartment 14 at a cool temperature that is typically above 0° C., so as not to freeze the articles of food in the fresh food compartment 14. It is contemplated that the cool temperature preferably is between 0° C. and 10° C., more preferably between 0° C. and 5° C. and even more preferably between 0.25° C. and 4.5° C. According to some embodiments, cool air from which thermal energy has been removed by the freezer evaporator can also be blown into the fresh food compartment 14 to maintain the temperature therein greater than 0° C. preferably between 0° C. and 10° C., more preferably between 0° C. and 5° C. and eve more preferably between 0.25° C. and 4.5° C. For alternate embodiments, a separate fresh food evaporator can optionally be dedicated to separately maintaining the temperature within the fresh food compartment 14 independent of the freezer compartment 12. According to an embodiment, the temperature in the fresh food compartment 14 can be maintained at a cool temperature within a close tolerance of a range between 0° C. and 4.5° C., including any subranges and any individual temperatures falling with that range. For example, other embodiments can optionally maintain the cool temperature within the fresh food compartment 14 within a reasonably close tolerance of a temperature between 0.25° C. and 4° C.

In the embodiment shown, French-style doors 24, 26 are pivotally coupled to a cabinet 16 of the refrigerator 10 to restrict and grant access to the fresh food compartment 14 and the dispensing assembly 50 is positioned on a door front. It is contemplated that the dispensing assembly 50 may be positioned on a door side or edge or inside the cabinet 16.

Figure 2:
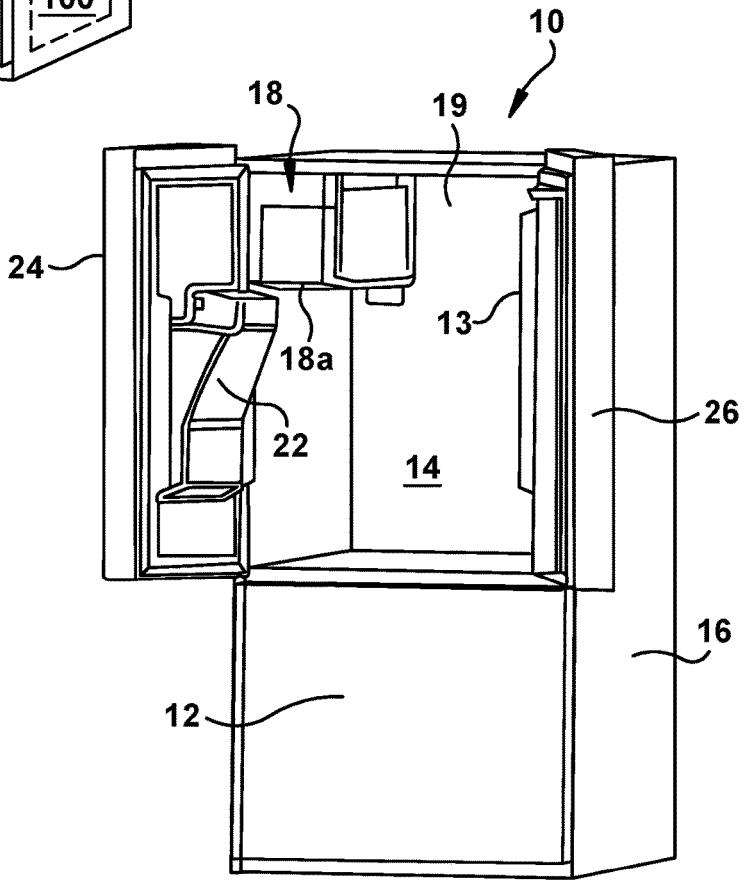
FIG. 2 is a front view of the refrigeration appliance of FIG. 1 showing the French-style doors of the fresh food compartment in an open position.

Referring to FIG. 2, when the doors 24, 26 are in an open position, access is granted to the ice maker 18 disposed in the fresh food compartment 14. The ice maker 18 includes an outlet 18*a* for supplying ice cubes to the ice chute 22 connected to a dispensing assembly (FIG. 1) in the door 24.

Figure 3:
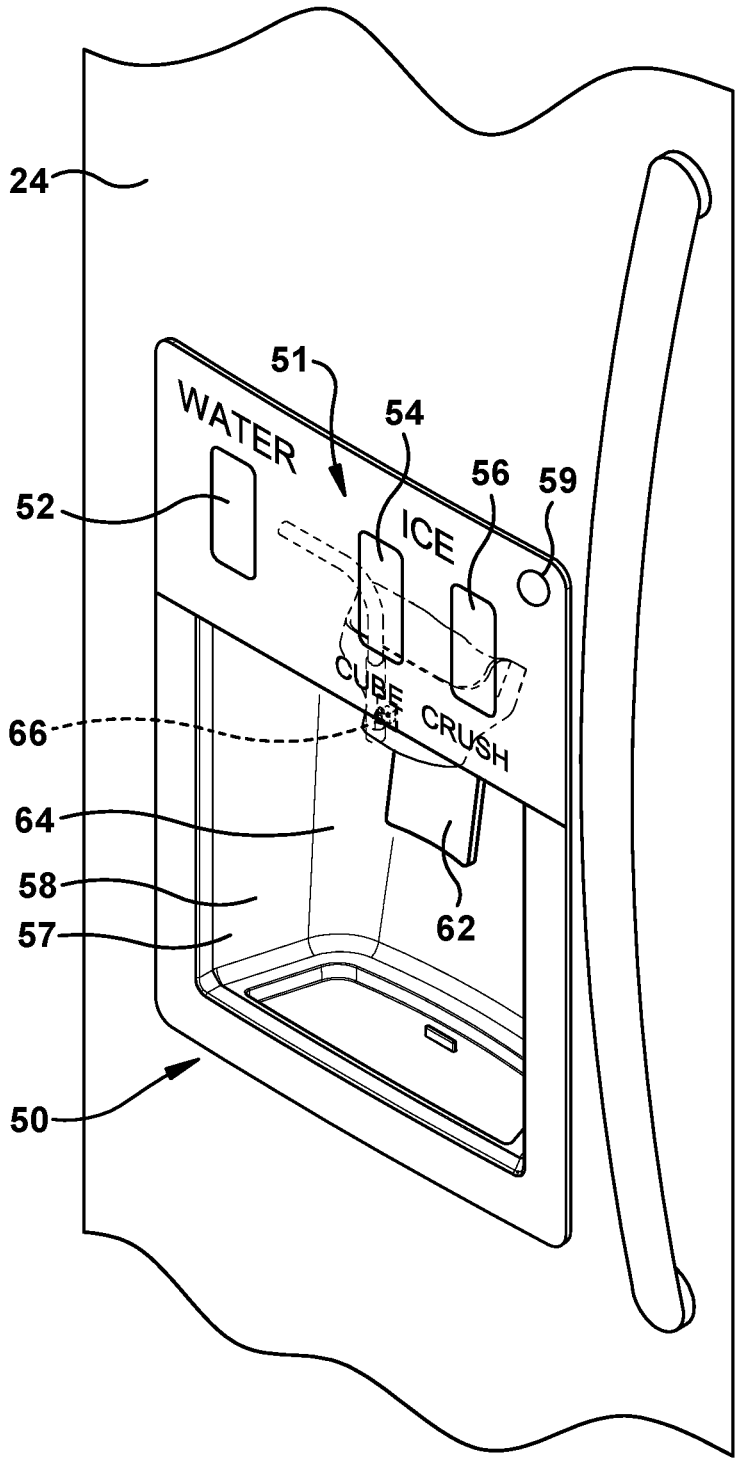
FIG. 3 is an enlarged perspective view of the dispensing station of FIG. 1.

Referring to FIG. 3, the dispensing assembly 50 includes a plurality of buttons 52, 54, 56 on a display portion 51 for allowing a user to select to dispensing water, ice cubes and crushed ice, respectively from the dispensing assembly 50. The first button 52 is a water selection button, the second button 54 is an ice cube selection button and the third button 56 is a crushed ice selection button. A sensor 59 may be positioned on the display portion 51. The sensor 59 may be configured for detecting the presence of a user at a predetermined distance from a front surface of the display portion 51. It is contemplated that the predetermined distance may be variable or fixed, e.g., 0.5 m, 1.0 m, etc. The sensor 59 may be configured to send a signal to a controller 100 (described below) after detecting the presence of the user at the predetermined distance for a predetermined period of time. It is contemplated that the predetermined period of time may be variable or fixed, e.g., 3 secs, 5 secs, etc. It is contemplated that the sensor 59 may be an optical sensor, a capacitive sensor, an infrared (IR) sensor, a photocell, etc.

The dispensing assembly 50 includes a housing 57 that defines a recess or cavity 58 of the dispensing assembly 50. The recess or cavity 58 is configured and dimensioned to receive a container 21, e.g., a bottle (FIG. 4), a cup, a carafe, etc. An actuator or lever 62 is positioned on a rear wall of the housing 57. The actuator 62 is configured such that when the container 21 is pressed against the actuator 62 the product selected by the user using the buttons 52, 54, 56 is delivered to the container 21. In particular, a chute 64 and a dispensing tube 66 are positioned in front of the actuator 62 such that when the actuator 62 is pressed the selected object will be dispensed, i.e., water, ice cubes or crushed from the chute 64 or from the dispensing tube 66.

Figure 4:
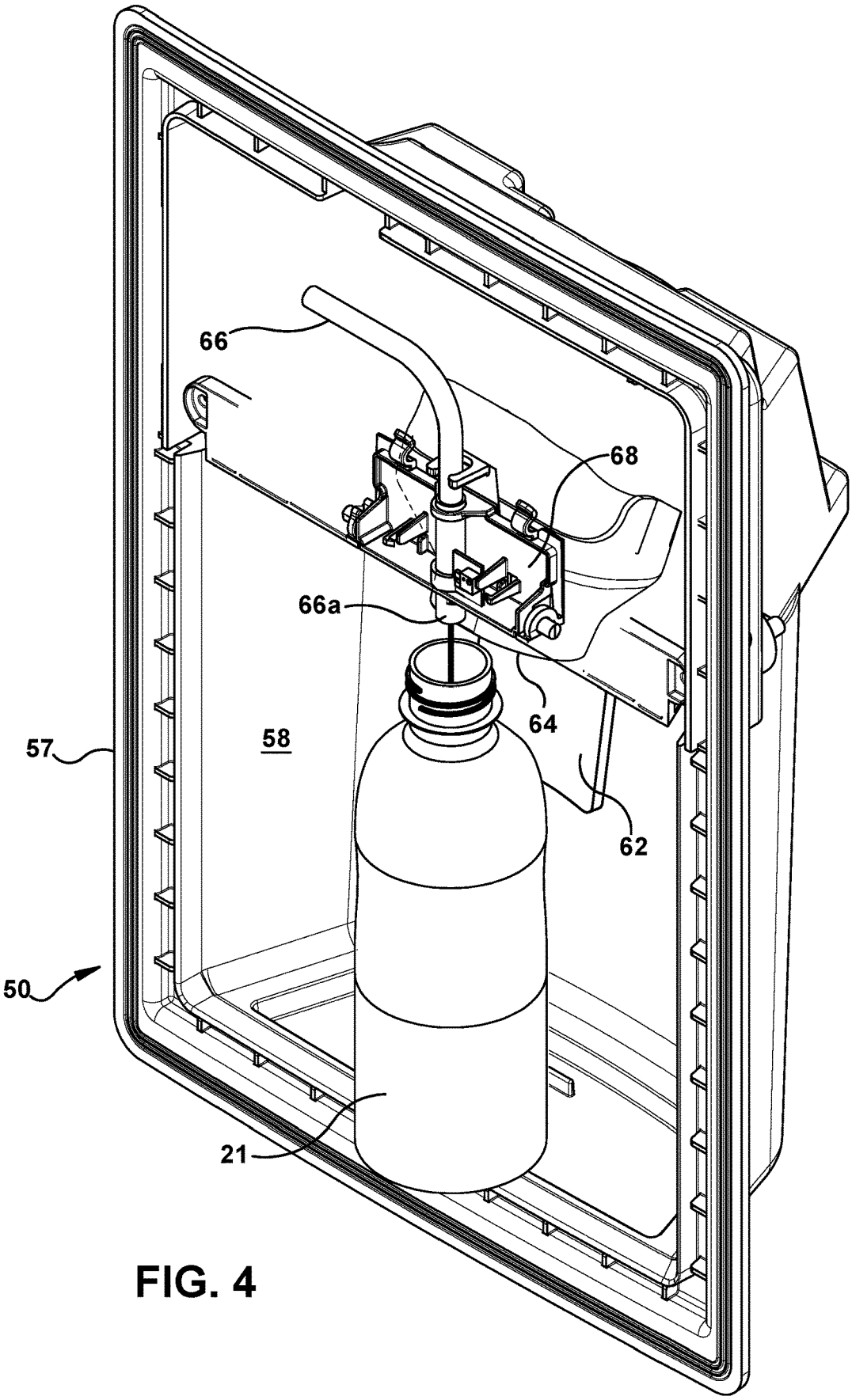
FIG. 4 is an enlarged perspective view of the dispensing station of FIG. 3 with a front cover removed, according to a first embodiment of the present invention.
Figure 5:
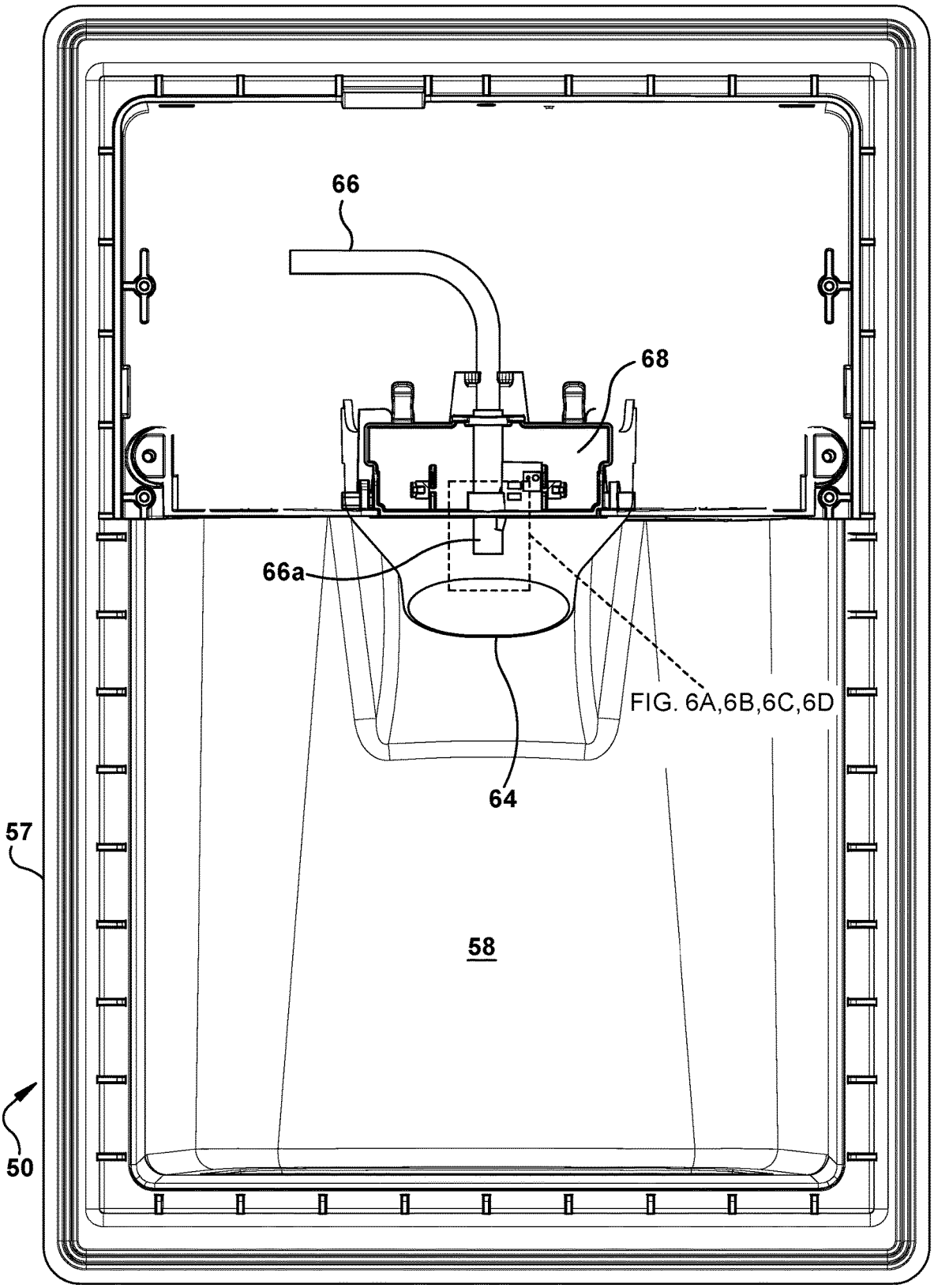
FIG. 5 is a front view of the dispensing station of FIG. 4.

Referring to FIGS. 4 and 5, wherein a front cover of the dispensing assembly 50 and a skin of the refrigerator 10 are removed for clarity, the internal components of the dispensing assembly 50 is shown. A bracket 68 is positioned in an upper portion of the housing 57 for supporting a distal end of the dispensing tube 66. The dispensing tube 66 of the dispensing assembly 50 has an outlet end 66*a* that extends in front of the actuator 62. An opposite end of the dispensing tube 66 is connected to a source of water (not shown) and a valve (not shown) is provided for controlling the flow of water through the dispensing tube 66.

Figure 6A:
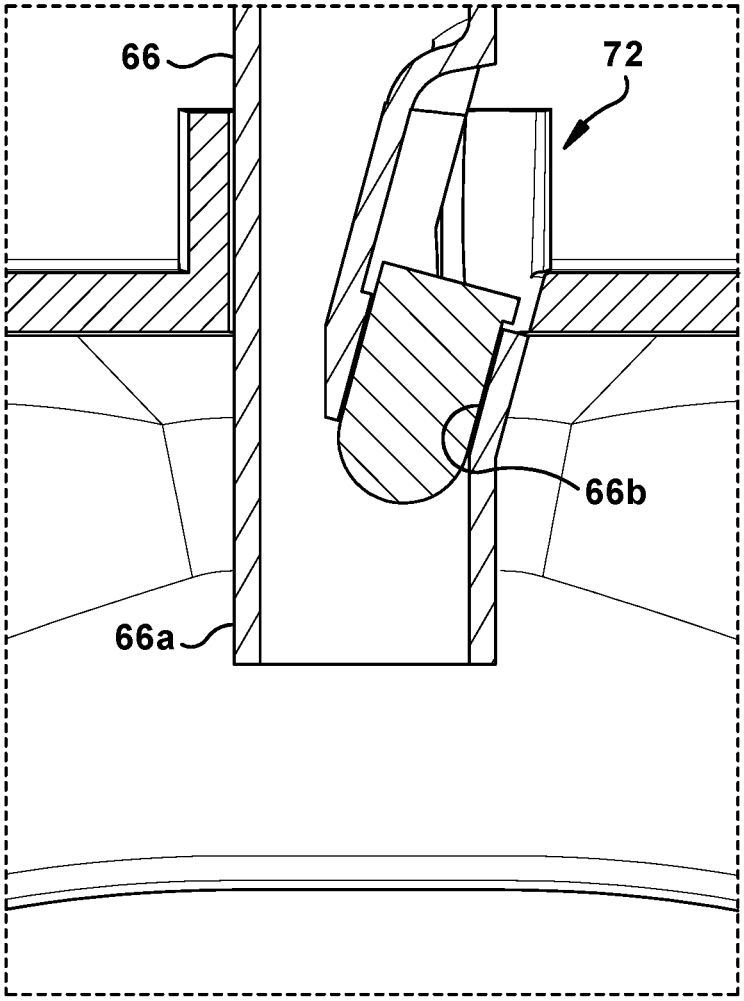
FIG. 6A is an enlarged section view taken from FIG. 5 showing an illumination device according to the first embodiment.
Figure 6B:
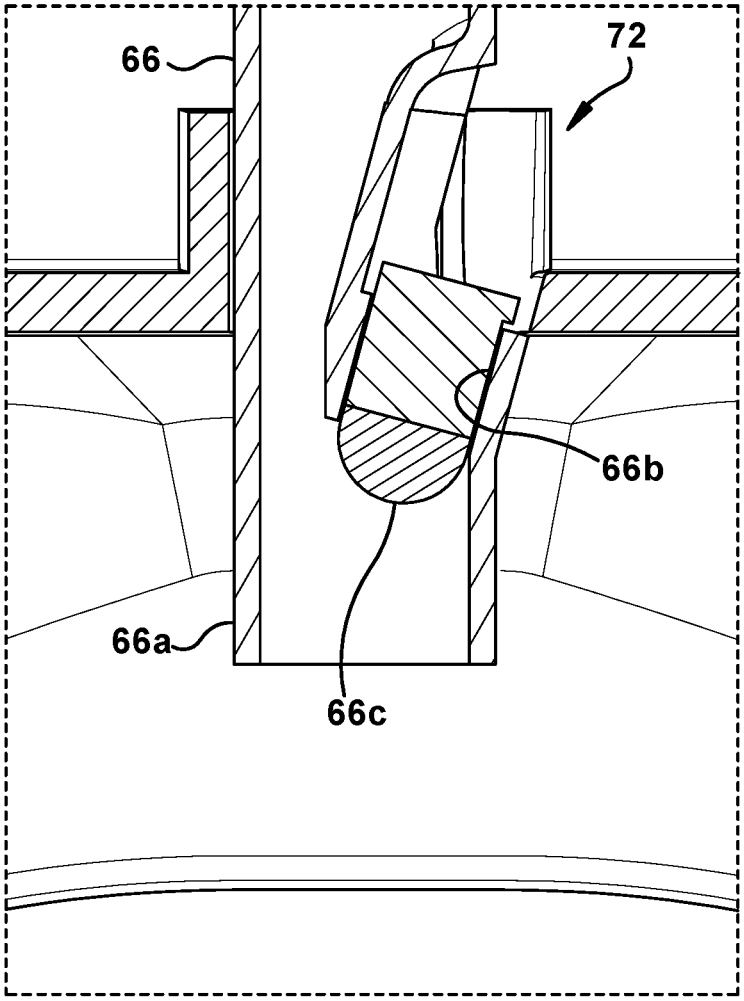
FIG. 6B is an enlarged section view taken from FIG. 5 showing an illumination device according to the first embodiment with a lens proximate an illumination device.

Referring to FIGS. 5, 6A, 6B, 6C, 6D a first illumination device 72 is shown attached to the dispensing tube 66. As shown in FIGS. 6A, 6B, the dispensing tube 66 includes an opening 66*b* formed in a wall of the dispensing tube 66 that is dimensioned and positioned to receive the first illumination device 72. The first illumination device 72 includes a light device, e.g., a light emitting diode (LED) that extends into the opening 66*b* of the dispensing tube 66. The first illumination device 72 is positioned and configured to illuminate the water passing through the dispensing tube 66 when the first illumination device 72 is energized. It is contemplated that the opening 66*b* and the first illumination device 72 are dimensioned to form a fluid tight seal therebetween such that water passing through the dispensing tube 66 does not leak pass the first illumination device 72. It is also contemplated that the opening 66*b* may be closed by a transparent wall or lens 66*c* (FIG. 6B) that the first illumination device 72 shines light through. The transparent wall or lens 66*c* may be formed integral with the dispensing tube 66. As such, the first illumination device 72 may not be in direct contact with the water passing through the dispensing tube 66.

Figure 6C:
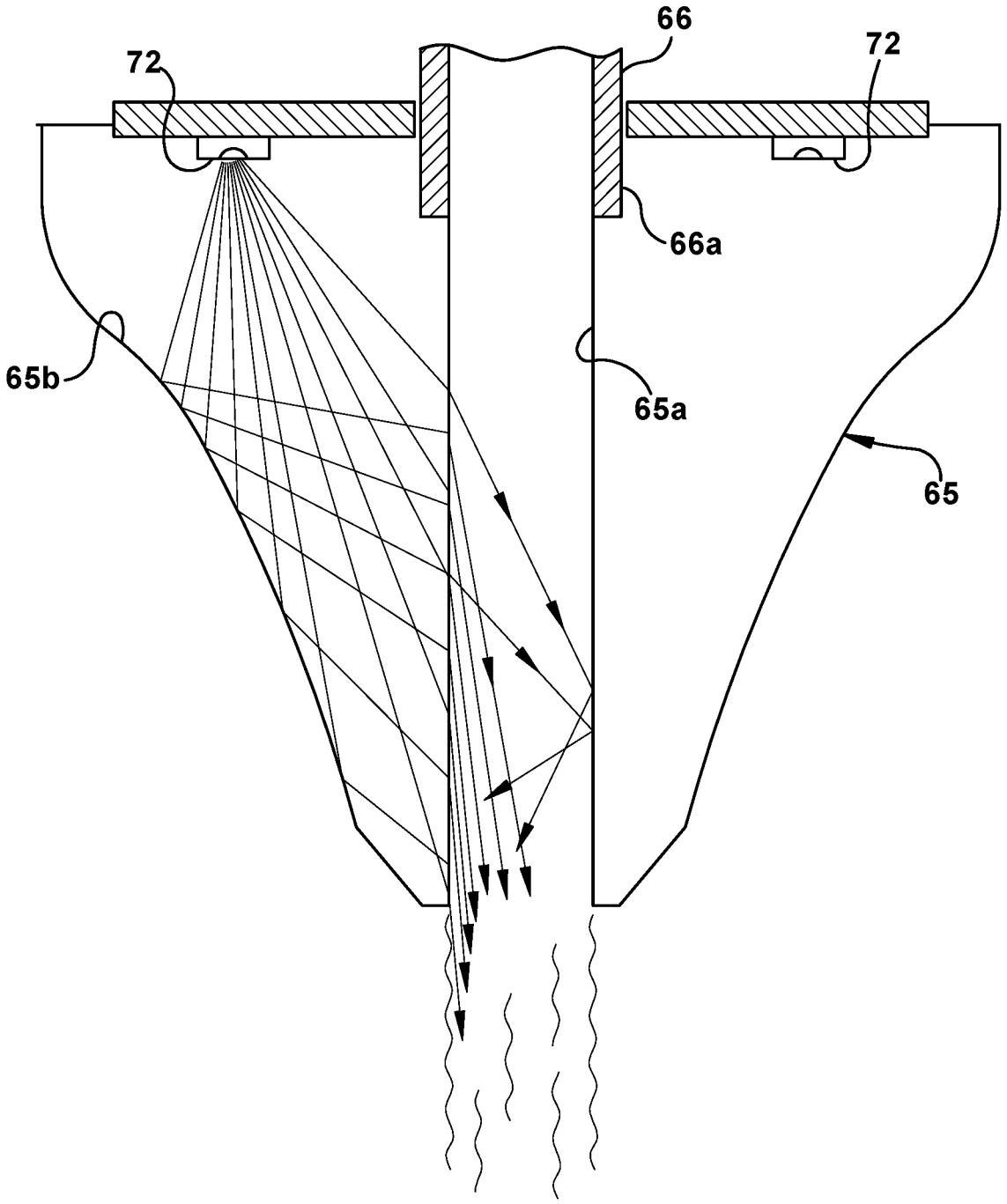
FIG. 6C is an enlarged section view taken from FIG. 5 showing an illumination device according to an alternative first embodiment with a reflective housing proximate a pair of illumination devices.

According to an alternative embodiment, shown in FIG. 6C, the outlet end 66*a* of the dispensing tube 66 engages a reflective housing 65. In the embodiment shown, the reflective housing 65 is attached to and surrounds the outlet end 66*a* of the dispensing tube 66. It is contemplated that the reflective housing 65 may be a removable component that can be attached to and detached from the dispensing tube 66, as needed. It is also contemplated that only a portion of the outlet end 66*a* of the dispensing tube 66 may extend through the reflective housing 65 such that the reflective housing 65 defines a water outlet of the dispensing assembly 50. The outlet end 66*a* of the dispensing tube 66 is positioned and dimensioned to align with an opening 65*a* that extends through the reflective housing 65. In the embodiment shown, at least one, preferably two, first illumination devices 72 are positioned proximate the opening 65*a* at a location adjacent to or in the reflective housing 65. In the embodiment illustrated, two first illumination devices 72 are positioned on opposite sides of the opening 65*a*.

The reflective housing 65 may be made from a material that provides internal reflection of light to direct the light toward the opening 65*a* of the reflective housing 65. It is contemplated that the reflective housing 65 may have an external cladding layer that is designed to keep light within the reflective housing 65. In particular the reflective cladding layer may be on a sidewall 65*b* of the reflective housing 65. The sidewall 65*b* may be contoured such that when the first illumination devices 72 are energized, the light from the first illumination devices 72 reflects off the sidewall 65*b*. The contoured reflective sidewall 65*b* may be dimension to direct the light into the opening 65*a* of the reflective housing 65 to illuminate the water passing through the opening 65*a*.

Figure 6D:
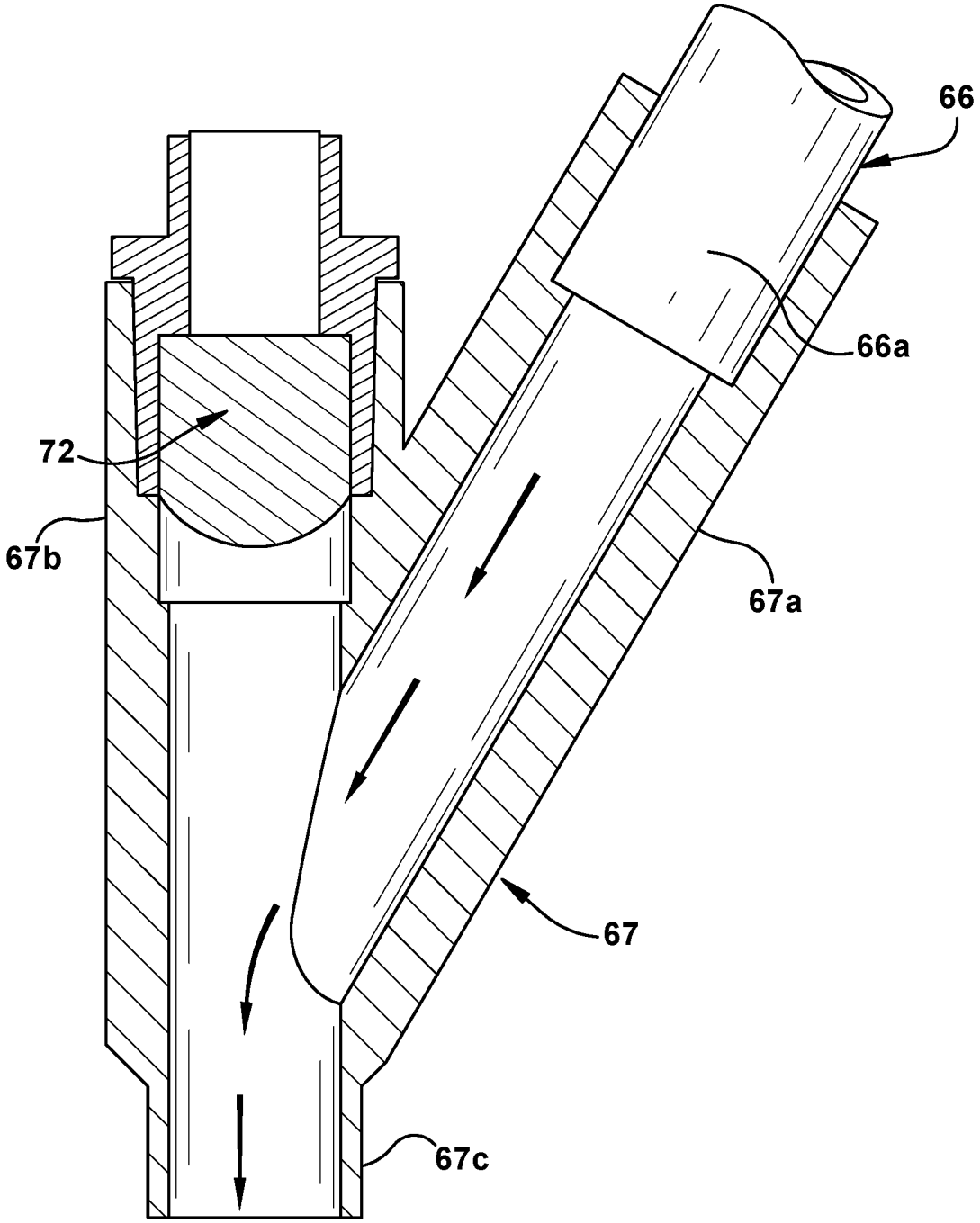
FIG. 6D is an enlarge section view taken from FIG. 5 showing an illumination device according to another alternative first embodiment with the illumination device disposed in a branched tube.

According to yet another alternative embodiment, shown in FIG. 6D, the dispensing tube 66 attaches to a branched tube 67. A first leg 67*a* of the branched tube 67 is dimensioned to engage the outlet end 66*a* of the dispensing tube 66. A second leg 67*b* of the branched tube 67 is dimensioned to receive the first illumination device 72. A third leg 67*c* extends from the junction between the first leg 67*a* and the second leg 67*b* and provides an outlet for the branched tube 67. The second leg 67*b* is dimensioned and positioned such that light from the first illumination device 72 is directed along the third leg 67*c*. As the fluid from the dispensing tube 66 flows through the branched tube 67 and exits out of the third leg 67*c*, the first illumination device 72 illuminates the fluid. In the embodiment shown, the branched tube 67 is Y-shaped. It is contemplated that the branched tube 67 could have other shapes and/or configurations so long as the light emitted from the first illumination device 72 illuminates the water exiting the branched tube 67.

Figure 7:
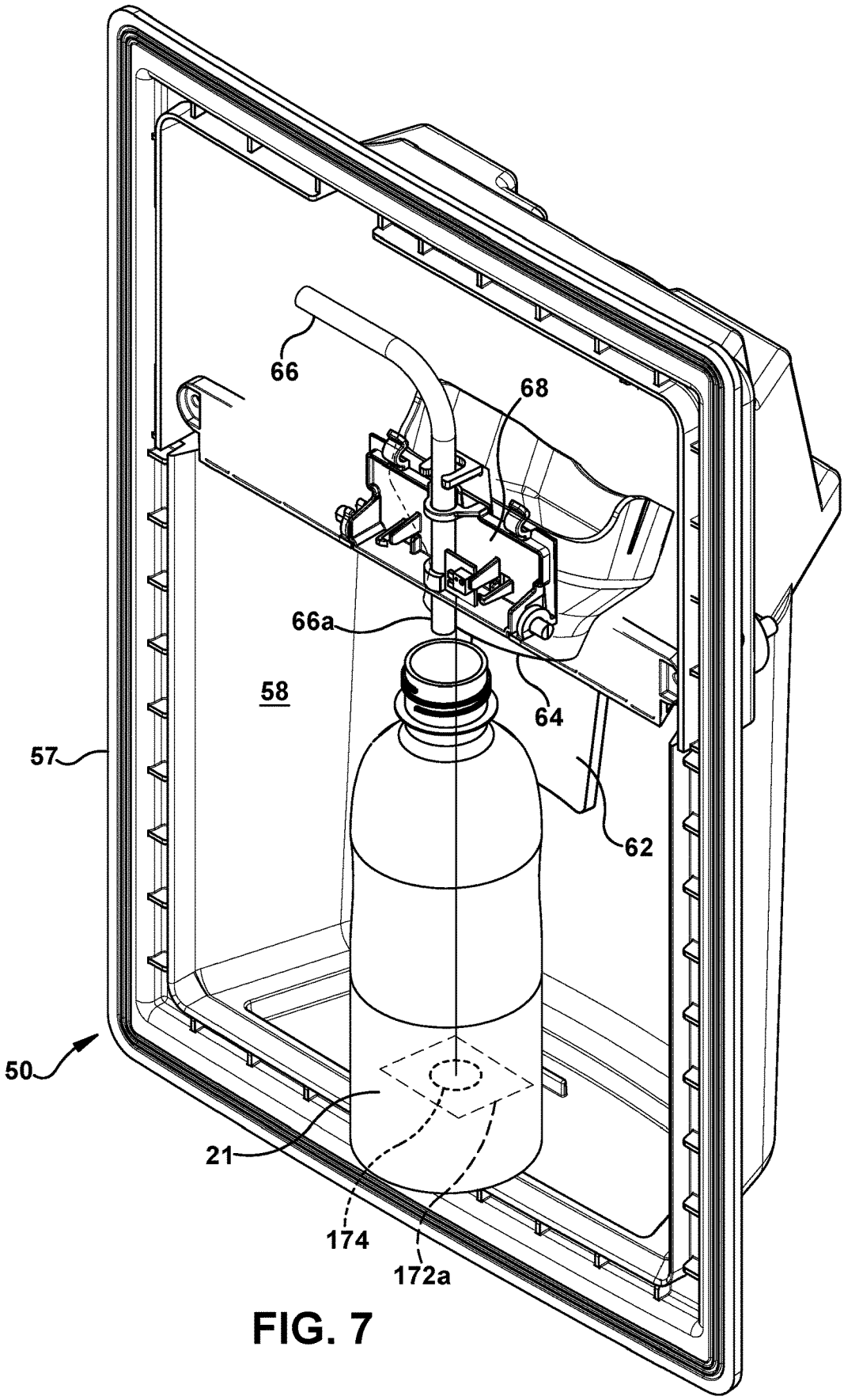
FIG. 7 is an enlarged perspective view of the dispensing station of FIG. 3 with a front cover removed, according to a second embodiment of the present invention.
Figure 8:
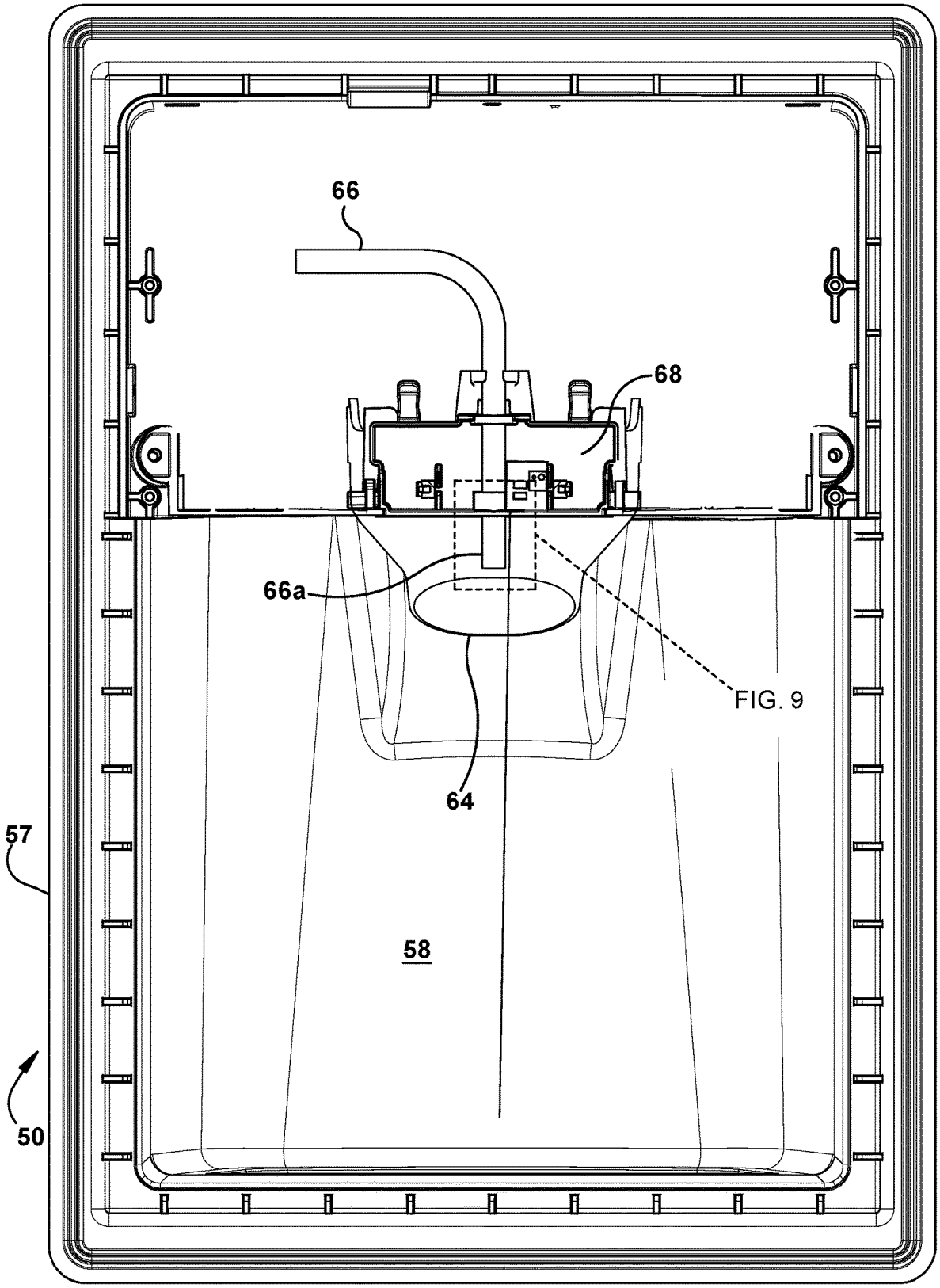
FIG. 8 is a front view of the dispensing station of FIG. 7.
Figure 9:
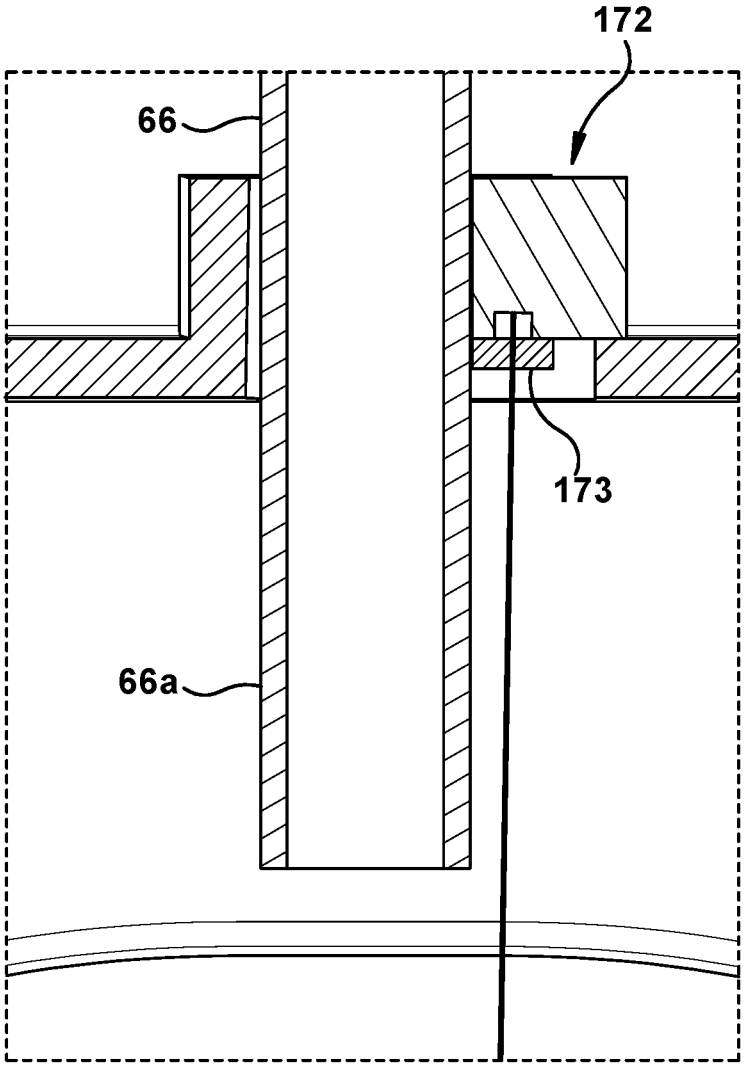
FIG. 9 is an enlarged section view taken from FIG. 8 showing an illumination device according to the second embodiment.

Referring to FIGS. 7-9, a second illumination device 172 is shown. Similar to the first illumination device 72, the second illumination device 172 includes a light device, e.g., a laser, a conventional light bulb, a light emitting diode (LED), etc. As shown in FIG. 9, the second illumination device 172 is positioned adjacent the outlet end 66*a* of the dispensing tube 66. As illustrated in FIG. 7, the second illumination device 172 does not directly illuminate the water passing through the dispensing tube 66 but illuminates a predetermined target location 174 in the cavity 58 of the dispensing assembly 50. In FIG. 9 the second illumination device 172 is illustrated as aligning with a distal end of the dispensing tube 66. It is contemplated that the second illumination device 172 may be angled relative to the distal end of the dispensing tube 66 so that the target location 174 corresponds to a position of a terminal end of a water stream exiting from the dispensing tube 66. It is contemplated that the predetermined target location 174 illuminated by second illumination device 172 may be inside the container 21 when the container 21 is positioned in the housing 57 of the dispensing assembly 50.

It is contemplated that a lens 173 may be disposed on the second illumination device 172 for producing a design, e.g., a symbol, an icon, a number, a letter, etc. at the predetermined target location 174.

According to another embodiment, as shown in FIG. 7, it is contemplated that the second illumination device 172 may include a light device 172*a* with a lens that is positioned on a bottom wall of the housing 57 at the predetermined location 174. In this embodiment, the light from the light device 172*a* shines upwards from the bottom wall of the housing 57 as opposed to the previous embodiment where the light shined downwards onto the bottom wall. When the light device 172*a* is energize, light from the light device 172*a* will direct a light upwards from the predetermined target location 174 that corresponds to the position of the terminal end of the water stream exiting from the dispensing tube 66.

The refrigerator 10 may include the controller 100 (FIG. 1) for controlling the operation of the dispensing assembly 50. The controller 100 can function in response to input signals from components of the dispensing assembly 50, including the plurality of buttons 52, 54, 56 and the actuator 62. The controller 100 can be arranged so that, in response to input signals from these components, the controller 100 will issue output signals to selectively cause the first illumination device 72 and/or the second illumination device 172 to be energized, to cause water to be delivered through the dispensing tube 66 (i.e., by actuating a solenoid valve (not shown)) and/or to cause cubed or crushed ice to be delivered through the chute 64.

For example, in the event the controller 100 receives an input signal from the actuator 62 and an input signal from the first button 52, i.e., the water selection button the controller can issue an output signal to the second illumination device 172 causing the second illumination device 172 to be energized before water is dispensed from the dispensing tube 66. The second illumination device 172 will illuminate the target location 174 to indicate the position of the terminal end of the water stream exiting from the dispensing tube 66. The illumination of the predetermined target location 174 may assist a user in recognizing where the water will be dispensed from the dispensing tube 66. Optionally, the controller 100 may then energize the first illumination device 72 at the same time that water is dispensed from the dispensing tube 66 or a few seconds before the water is dispensed from the dispensing tube 66.

As described above, the sensor 59 may detect when the user is within the predetermined distance from the front surface of the display portion 51. Upon receiving a signal from the sensor 59, the controller 100 may energize the second illumination device 172 to illuminate the target location 174 and indicate the position of the terminal end of the water stream exiting from the dispensing tube 66.

It is also contemplated that the first and/or second illumination devices 72, 172 may be configured so that a user may select the color produced by the first and/or second illumination devices 72, 172. It is also contemplated that the color of the light produced by the first and/or second illumination devices 72, 172 can vary based a condition of the refrigerator 10. For example, the refrigerator 10 typically will include a water filter (not shown) for the water that is dispensed at the dispensing assembly 50. A user may find it useful to know when the water filter is in need of replacement. In that event, the first and/or second illumination devices 72, 172 can be operatively associated with the water filter, whereby the first and/or second illumination devices 72, 172 are energized when the water filter is in need of being replaced. For example, the water filter can include a signaling device for generating an electrical output signal to the controller 100 that would cause the first and/or second illumination devices 72, 172 to illuminate in an identifying selected color when the water filter is in need of being replaced. For example, the color green may indicate that the water filter is good, the color yellow may indicate that the water filter has almost reached its end of life and the color red may indicate that the water filter needs replacing.

In addition or alternatively, the ice maker of the present application may further be adapted to mounting and use on a freezer door. In this configuration, although still disposed within the freezer compartment, at least the ice maker (and possibly an ice bin) is mounted to the interior surface of the freezer door. It is contemplated that the ice mold and ice bin can be separated elements, in which one remains within the freezer cabinet and the other is on the freezer door.

Cold air can be ducted to the freezer door from an evaporator in the fresh food or freezer compartment, including the system evaporator. The cold air can be ducted in various configurations, such as ducts that extend on or in the freezer door, or possibly ducts that are positioned on or in the sidewalls of the freezer liner or the ceiling of the freezer liner. In one example, a cold air duct can extend across the ceiling of the freezer compartment, and can have an end adjacent to the ice maker (when the freezer door is in the closed condition) that discharges cold air over and across the ice mold. If an ice bin is also located on the interior of the freezer door, the cold air can flow downwards across the ice bin to maintain the ice pieces at a frozen state. The cold air can then be returned to the freezer compartment via a duct extending back to the evaporator of the freezer compartment. A similar ducting configuration can also be used where the cold air is transferred via ducts on or in the freezer door. The ice mold can be rotated to an inverted state for ice harvesting (via gravity or a twist-tray) or may include a sweeper-finger type, and a heater can be similarly used. It is further contemplated that although cold air ducting from the freezer evaporator as described herein may not be used, a thermoelectric chiller or other alternative chilling device or heat exchanger using various gaseous and/or liquid fluids could be used in its place. In yet another alternative, a heat pipe or other thermal transfer body can be used that is chilled, directly or indirectly, by the ducted cold air to facilitate and/or accelerate ice formation in the ice mold. Of course, it is contemplated that the ice maker of the instant application could similarly be adapted for mounting and use on a freezer drawer.

Alternatively, it is further contemplated that the ice maker of the instant application could be used in a fresh food compartment, either within the interior of the cabinet or on a fresh food door. It is contemplated that the ice mold and ice bin can be separated elements, in which one remains within the fresh food cabinet and the other is on the fresh food door.

In addition or alternatively, cold air can be ducted from another evaporator in the fresh food or freezer compartment, such as the system evaporator. The cold air can be ducted in various configurations, such as ducts that extend on or in the fresh food door, or possibly ducts that are positioned on or in the sidewalls of the fresh food liner or the ceiling of the fresh food liner. In one example, a cold air duct can extend across the ceiling of the fresh food compartment, and can have an end adjacent to the ice maker (when the fresh food door is in the closed condition) that discharges cold air over and across the ice mold. If an ice bin is also located on the interior of the fresh food door, the cold air can flow downwards across the ice bin to maintain the ice pieces at a frozen state. The cold air can then be returned to the fresh food compartment via a ducting extending back to the compartment with the associated evaporator, such as a dedicated icemaker evaporator compartment or the freezer compartment. A similar ducting configuration can also be used where the cold air is transferred via ducts on or in the fresh food door. The ice mold can be rotated to an inverted state for ice harvesting (via gravity or a twist-tray) or may include a sweeper-finger type, and a heater can be similarly used. It is further contemplated that although cold air ducting from the freezer evaporator (or similarly a fresh food evaporator) as described herein may not be used, a thermoelectric chiller or other alternative chilling device or heat exchanger using various gaseous and/or liquid fluids could be used in its place. In yet another alternative, a heat pipe or other thermal transfer body can be used that is chilled, directly or indirectly, by the ducted cold air to facilitate and/or accelerate ice formation in the ice mold. Of course, it is contemplated that the ice maker of the instant application could similarly be adapted for mounting and use on a fresh food drawer.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A refrigeration appliance comprising:

a cabinet defining a storage compartment;

a door pivotably coupled to the cabinet and movable between a closed position for closing the storage compartment and an open position for allowing access to the storage compartment; and a dispensing assembly disposed on at least one of the cabinet and the door for supplying water and/or ice, the dispensing assembly including:

a dispensing tube fluidly connected to a source of water and having an outlet opening for allowing a stream of water to exit the dispensing tube upon command;

a first illumination device disposed proximate the dispensing tube for illuminating the stream of water exiting from the dispensing tube; and a reflective housing surrounding the outlet opening of the dispensing tube and the first illumination device and having a reflective cladding layer on a contoured sidewall of the housing for directing light from the first illumination device to an outlet opening of the reflective housing.

2. The refrigeration appliance of claim 1, further comprising a second illumination device for illuminating a predetermined target location that corresponds to a position of a terminal end of the stream of water exiting from the dispensing tube.

3. The refrigeration appliance of claim 2, wherein at least one of the first illumination device and the second illumination device is configured to produce light of various colors.

4. The refrigeration appliance of claim 1, wherein the first illumination device is configured to produce light of various colors.

5. The refrigeration appliance of claim 1, wherein the first illumination device and the outlet opening of the dispensing tube both extend into an upper surface of the reflective housing.

6. The refrigeration appliance of claim 1, further comprising a second illumination device, the first and second illumination devices disposed on opposite sides of the outlet opening of the dispensing tube.

* * * * *